US012083398B2

(12) United States Patent
Burgess et al.

(10) Patent No.: US 12,083,398 B2
(45) Date of Patent: Sep. 10, 2024

(54) GOLF BAG HAVING BASE MADE OF COMPOSITE SHEET MATERIAL

(71) Applicant: Acushnet Company, Fairhaven, MA (US)

(72) Inventors: Ian Burgess, Tiverton, RI (US); Stephanie L Howard, Boston, MA (US); Benjamin J. Beck, Boston, MA (US); Ryan Donovan, Newton, MA (US)

(73) Assignee: Acushnet Company, Fairhaven, MA (US)

( * ) Notice: Subject to any disclaimer, the term of this patent is extended or adjusted under 35 U.S.C. 154(b) by 113 days.

(21) Appl. No.: 17/489,862

(22) Filed: Sep. 30, 2021

(65) Prior Publication Data

US 2022/0105400 A1 Apr. 7, 2022

Related U.S. Application Data

(60) Provisional application No. 63/123,026, filed on Dec. 9, 2020, provisional application No. 63/088,003, filed on Oct. 6, 2020.

(51) Int. Cl.
*A63B 55/00* (2015.01)

(52) U.S. Cl.
CPC ..... *A63B 55/408* (2015.10); *A63B 2209/023* (2013.01)

(58) Field of Classification Search
CPC ..... A63B 55/408; A63B 2209/023
USPC ..... 206/315.3
See application file for complete search history.

(56) References Cited

U.S. PATENT DOCUMENTS 6,062,383 A 5/2000 Han
6,380,349 B1 * 4/2002 Rajagopalan ..... C08F 8/44 206/315.3
6,386,362 B1 * 5/2002 Cheng ..... A63B 55/53 206/315.3
6,412,734 B2 * 7/2002 Lin ..... A63B 55/57 206/315.7
6,568,527 B1 5/2003 Cheng
6,938,762 B2 9/2005 Cheng
(Continued)

FOREIGN PATENT DOCUMENTS

CN 207041843 U * 2/2018 ..... A63B 55/00
WO WO-2015075631 A1 * 5/2015 ..... A61F 13/00

OTHER PUBLICATIONS

Renashed: https://www.amazon.com/dp/B088WP41VL/ref=sspa_dk_detail_3?pd_rd_i=B088WP41VL&pd_rd_w=zchvJ&content-id=amzn1.sym.386c274b-4bfe-4421-9052-a1a56db557ab&pf_rd_p=386c274b-4bfe-4421-9052a1a56db557ab&pf_rd_r=4JCFKZF2464YNZ5YS02W&pd_rd_wg=HzB5h&pd_rd_r=91a2b3e9-7a4d-4423-a0ef-060bcf0&s=hi&sp_csd=d2lkZ2V0TmFtZT1zcF9kZXRhaWxfdGhlbWF0aWM&spLa=ZW5jcnlwdGVkUXVhbGlmaWVyPUFEODFUNIdQWIZGQ0UmZW5jcnlwdGVkSWQ9QTAwMjQ5OTEzTEINREXNDIOMFNCJmVuY3J5CHRIZEFKSWQ9QTA1NjA5NTMxMTFCNzQyNTBJRUpTJndpZGdldE5hbWU9c3BfZGVOYWIsX3RoZW1hdGljJmFjdGlvbj1jbGlja1JIZGlyZWN0JmRvTm90TG9nQ2xpY2s9dHJ1ZQ&th=1 (Year: 2020).*

(Continued)

*Primary Examiner* — Don M Anderson
*Assistant Examiner* — Jessica Kavini Tamil

(57) ABSTRACT

A golf bag having an improved base is provided. The golf bag is durable, lightweight, comfortable to carry, and easy to use. The base is made of a composite sheet material, preferably a self-reinforced polymer composite sheet material that has been thermoformed. Materials made of thermo- (Continued)

plastic polymers such as polyethylene, polypropylene, polyoxymethylene, and polyester can be processed under precise temperature and pressure conditions to form the self-reinforced polymer composite sheet material.

20 Claims, 13 Drawing Sheets

(56) References Cited

U.S. PATENT DOCUMENTS

| | | | | |
|---|---|---|---|---|
| 7,188,714 | B1 | 3/2007 | Herold | |
| 7,261,260 | B2 | 8/2007 | Tan | |
| 8,424,678 | B2 | 4/2013 | Anderson | |
| 8,616,369 | B2 | 12/2013 | Campbell et al. | |
| 8,657,111 | B2 | 2/2014 | Anderson et al. | |
| 8,910,785 | B2 | 12/2014 | Loudenslager | |
| 9,339,703 | B2 | 5/2016 | Anderson et al. | |
| 9,474,949 | B2 | 10/2016 | Campbell et al. | |
| 10,238,935 | B2 | 3/2019 | Anderson et al. | |
| 2006/0258811 | A1* | 11/2006 | Barcus | C08L 23/12 525/240 |
| 2009/0312118 | A1* | 12/2009 | Deshmukh | A63B 53/047 473/345 |

OTHER PUBLICATIONS

YouTube by Koolhunter: https://www.youtube.com/watch?v=E5D9QOnKYdg (Year: 2017).*

* cited by examiner

GOLF BAG HAVING BASE MADE OF COMPOSITE SHEET MATERIAL

CROSS-REFERENCE TO RELATED APPLICATIONS

This application claims the benefit of U.S. Provisional Application No. 63/123,026, filed Dec. 9, 2020 and U.S. Provisional Application No. 63/088,003, filed Oct. 6, 2020, the entire disclosures of which are incorporated by reference.

BACKGROUND OF THE INVENTION

Field of the Invention

The present invention generally relates to golf bags having an improved base. In one embodiment, the base is made of a composite sheet material, preferably a self-reinforced polymer composite sheet material that has been thermoformed. Materials made of thermoplastic polymers such as polyethylene, polypropylene, polyoxymethylene, and polyester can be processed under precise temperature and pressure conditions to form the self-reinforced polymer composite sheet. The golf bag having the improved base is durable, lightweight, comfortable to carry, and easy to use.

Brief Review of the Related Art

Both professional and recreational golfers use their golf bags for many different purposes today. The bags are normally designed to carry many items including golf clubs and balls, and accessories such as head covers, towels, hats, umbrellas, and golf tees. Many golf courses require that golfers walk the entire course and carry their own bags. Thus, the golfer is constantly placing the bag over his/her shoulders, removing the bag from their shoulders, and placing the bag down or standing-up the bag using a support leg mechanism coupled to the bag. The golfer is also constantly removing clubs from the bag and inserting them back into the bag. Thus, the golf bag needs to be durable, lightweight, comfortable to carry, and easy to use.

More particularly, the golf bag is an important piece of equipment for the golfer who will walk a considerable distance during their round of play. Depending upon the length of the course, speed of play, and other factors, a golfer may walk a few miles in a round. The terrain on the golf course varies considerably and the golf bag needs to be is placed on both level and non-level surfaces during a typical round. For example, the golf bag can be placed in an upright position when the ground is fairly level such as on a fairway. In this position, the entire bottom surface of the base contacts the ground. In other instances, the golfer will need to place the bag in a tilted, propped-up position when there are non-level surfaces such as hills and valleys and rough surfaces littered with rocks and sticks. Thus, the golf bag, and particularly the base of the bag, needs to be easily adjustable. The golf bag also needs to be durable enough to carry clubs, balls, and accessories, and yet, at the same time, the bag needs to be lightweight and flexible. The golfer needs to be able to organize his/her clubs in the bag, walk comfortably on the course with the bag, and do other golf-specific actions. The present invention provides a golf bag that is durable, lightweight, comfortable to carry, and easy to use and includes other advantageous properties and features. The golf bag of this invention includes an improved base to support the bag.

SUMMARY OF THE INVENTION

The present invention provides a golf bag having an improved base. In one embodiment, the golf bag comprises an elongated tubular body for storing golf clubs. The tubular body has a top opening and a closed bottom base. The base has a front base section comprising a front bottom surface and a front sidewall formed of a plurality of composite sheets and a rear base section comprising a rear bottom surface and a rear sidewall formed of a plurality of composite sheets. The rear base section is pivotally connected to the front base section and has an angled tab that partially overlaps the front sidewall of the front base section. Thus, as the angled tab moves downwardly, the rear bottom surface pivots upwardly relative to the front bottom surface to a point wherein the rear bottom surface forms an angle of about 20 to about 60 degrees with the front bottom surface. The bag further comprises a first leg and a second leg pivotally attached to the tubular body; a first actuator rod having a proximal end that is coupled to an upper region of the first leg and a distal end that is coupled to the front base section; and a second actuator rod having a proximal end that is coupled to an upper region of the second leg and a distal end that is coupled to the front base section. As the rear base section pivots relative to the front base section, the actuator rods force the legs to move outwardly and into an extended position to support the bag.

The composite sheets used to form the front and rear base sections preferably comprise self-reinforced polymer composite sheet material. In one example, the self-reinforced polymer composite sheet material comprises a polypropylene homopolymer, copolymer, or terpolymer. The self-reinforced polymer composite sheet material can be formed from at least three successive layers. The self-reinforced polymer composite sheet material is preferably thermoformed to form the golf bag base sections.

In another embodiment, the golf bag comprises an elongated tubular body for storing golf clubs. The tubular body has a top opening and a closed bottom base, wherein the base comprises a self-reinforced polymer composite sheet material formed from at least three successive layers. In one embodiment, the self-reinforced polymer composite sheet material can comprise a top layer and a bottom layer of a first polymer; an intermediate layer comprising a second polymer with a similar chemical composition and grade as the first polymer with a lower degree of molecular orientation and lower melting temperature than the first polymer. The intermediate layer can have a first thickness that is less than a second thickness of either the top layer or bottom layer. Suitable polymers first and second polymers can be selected from the group consisting of polyethylene, polypropylene, polyoxymethylene, polyester, and copolymers and blends thereof. In one example, the top and bottom layers are non-woven webs. In another example, the top and bottom layers are formed from fabrics that are woven from flat tapes. In one example, the top, bottom, and intermediate layers each comprise a fabric. In another example, the top and bottom layers each comprise a fabric, and the intermediate layer comprises a film.

The self-reinforced polymer composite sheet material has many advantageous properties. For example, the self-reinforced composite sheet material can have a density of less than about 1.0 g/cm$^3$; a Charpy Impact strength greater than 90 kJ/m$^2$; a Tensile Strain to Failure of at least 10%; and/or a Compression Strength greater than 200 MPa. Preferably, the base of the golf bag is formed from the self-reinforced polymer composite sheet material by a thermoforming process.

In yet another embodiment, the golf bag comprises an elongated tubular body for storing golf clubs, the tubular body having a top opening and a closed bottom base, the base having a flexible intermediate section disposed between a front base section and rear base section, the flexible intermediate section forming an interface between the front and rear base sections such that the rear base section pivots relative to the front base section along the flexible section, the base comprising a self-reinforced polymer composite sheet material. Preferably, the base is formed from the self-reinforced polymer composite sheet material by a thermoforming process. The front and rear base sections can be formed of a self-reinforced polymer composite sheet material and the flexible section is formed of an elastomeric material such as rubber.

BRIEF DESCRIPTION OF THE DRAWINGS

The novel features that are characteristic of the present invention are set forth in the appended claims. However, the preferred embodiments of the invention, together with further objects and attendant advantages, are best understood by reference to the following detailed description in connection with the accompanying drawings in which:

DETAILED DESCRIPTION OF THE INVENTION

Golf Bag Assembly

Figure 1:
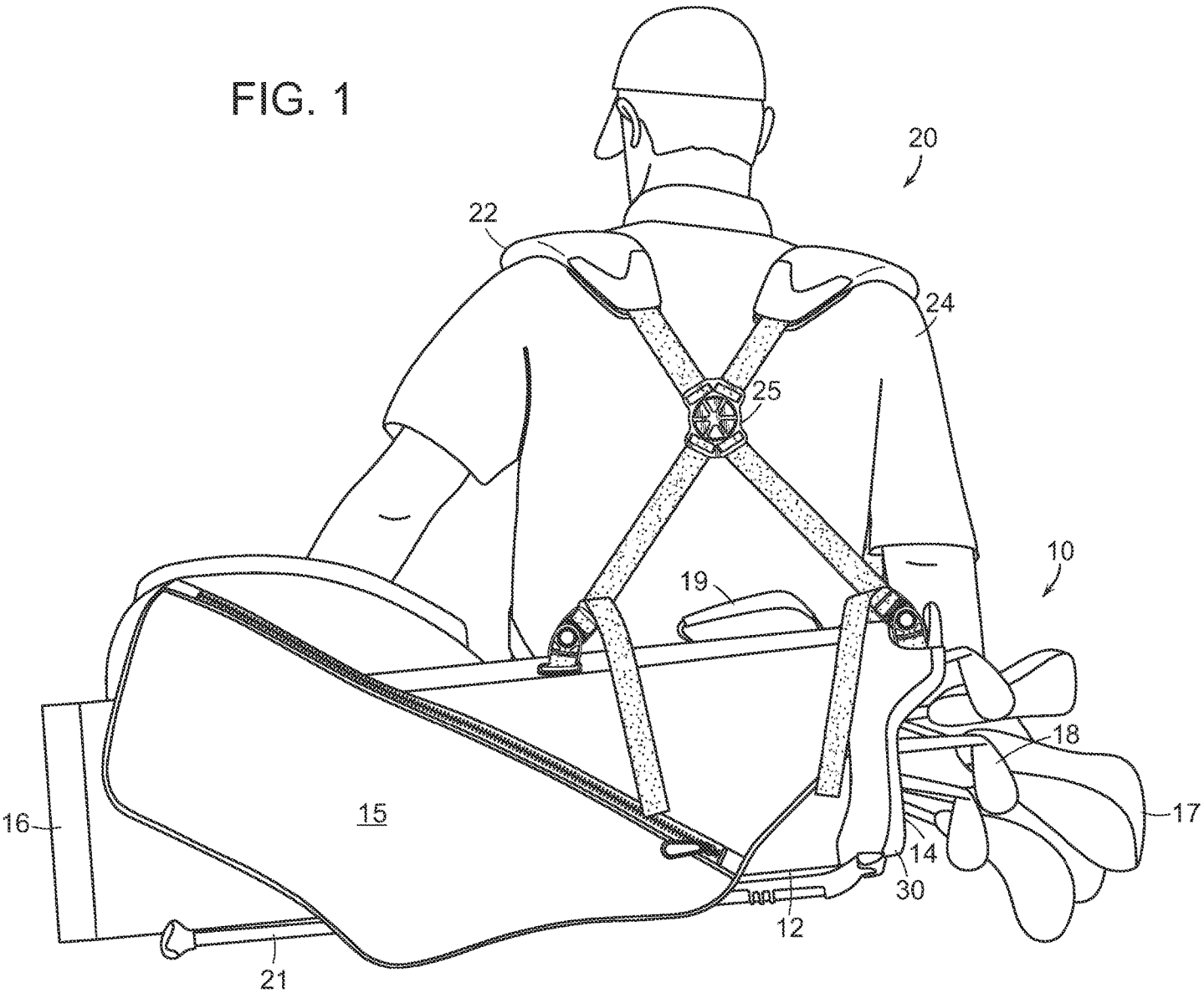
FIG. 1 is a rear perspective view of a person carrying one embodiment of a golf bag of this invention.

Referring to the Figures, where like reference numerals are used to designate like elements, FIG. 1 shows one embodiment of a golf bag (10) of this invention that generally includes an elongated tubular body (12) having an open end (14) and an opposing closed end or base (16) that is discussed further below. The base (16) of the present invention can be used in any suitable golf bag construction including, but not limited to, cart bags, stand bags, hybrid bags, carry bags, and the like. A golf stand bag is shown in FIG. 1 and golf stand bags are primarily described herein. Cart bags, hybrid bags, and carry bags also can be constructed and are described in further detail below. The sidewalls of the tubular body (12) may include zippered pockets (15) for golf balls and accessories such as apparel, towels, hats, gloves, tees, beverages, and the like. Golf clubs (18) can be placed in the tubular body (12) so that they are projecting from the open-end (14) of the golf bag (10). Some of the golf clubs may be protected with head covers (17). The tubular body (12) may further include a handle (19) for lifting and carrying the bag and a leg system (21) for supporting the bag in a standing position as described further below. The tubular body (12) is normally made of any suitable textile material including leather and woven/non-woven fabrics.

The bag (10) can further contain a shoulder strap system (20), for example, a two-strap system, wherein the golfer can bear the weight of the bag on both shoulders. The first strap (22) fits over a person's left shoulder and the second strap (24) fits over the right shoulder. These dual shoulder straps (22, 24) tend to help improve the weight distribution of the bag and less weight stress is placed on each shoulder. Other bags use a single-strap system, wherein the strap fits over one shoulder. In this way, the golfer or caddie can carry the bag and slip it off using either the left or right shoulder. In yet other bags, a convertible shoulder strap system (20), as shown in FIG. 1, is used. This strap system includes a strap connector (25), where the straps (22, 24) extend through diagonally opposed slots and criss-cross each other. The straps (22, 24) can be easily changed back and forth between a two-strap and single-strap system assembly by simply loosening and pulling away one strap from the strap connector (25). For example, if the golfer wishes to use only strap (22) and carry the bag (10) over the left shoulder, he/she removes the right-sided strap (24) from the strap connector (25) and lets it hang loosely or stores it in a pocket. The golfer then uses the strap (22) hanging over the left shoulder to support the weight of the bag (10). The strap system used on the golf bags of this invention help the golfer balance the bag evenly on their shoulders and back. The strap systems are comfortable and easy to use so the golfer can walk naturally and freely even when carrying these bags over the entire course.

The top frame (30) is positioned on the top opening (14) of the bag (10). The top frame (30) is constructed to provide some rigidity to the bag (10). The top frame (30) helps maintain the shape of the bag (10) when the bag is in a standing position or resting on the ground. The top frame (30) also helps to organize and protect the clubs in the bag.

Base Sub-Assembly

Figure 2:
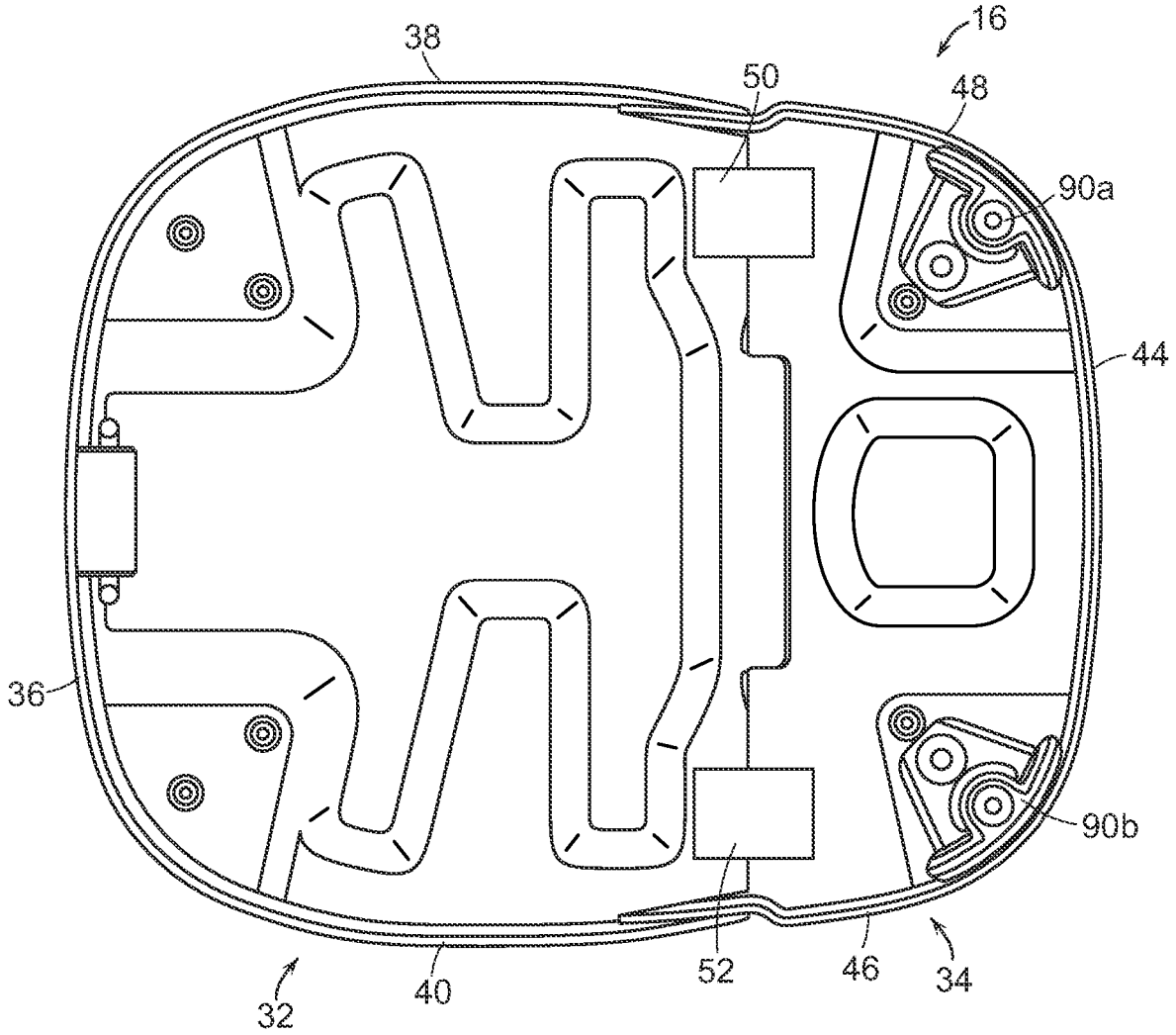
FIG. 2 is a top view of one embodiment of a base for a golf bag of this invention.
Figure 2A:
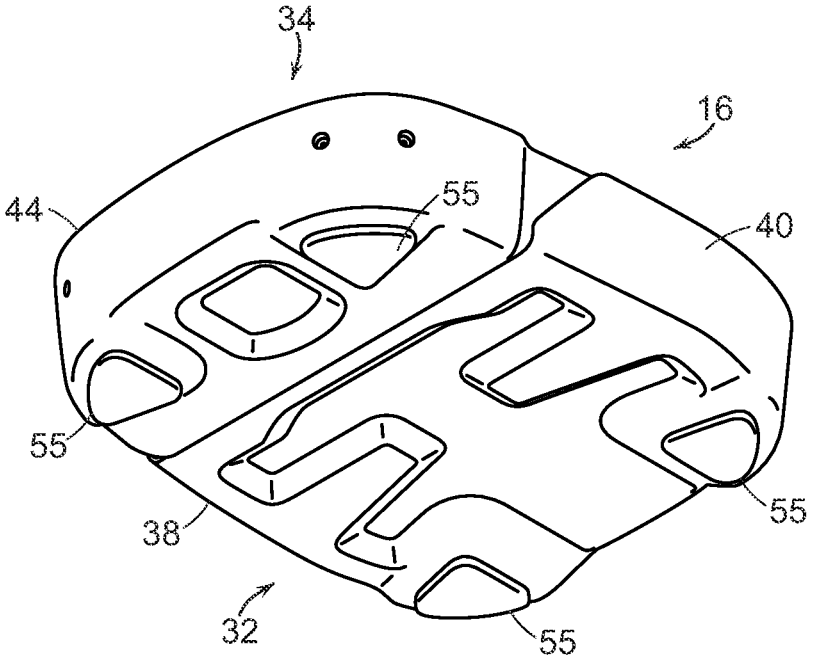
FIG. 2A is a perspective view of one embodiment of a base for a golf bag of this invention.
Figure 2B:
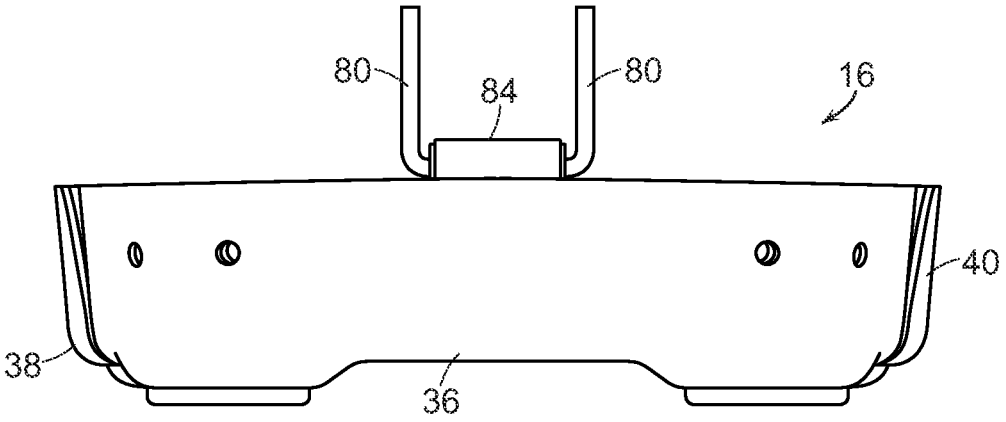
FIG. 2B is a front-end view of one embodiment of a base for a golf bag of this invention.

Referring to FIGS. 2, 2A, and 2B, in one embodiment, the bottom base (16) comprises a front section (32) and a rear section (34) that are pivotally connected to each other. In one embodiment, the base (16) is produced as a unitary piece and then cut into two separate pieces, front section (32) and rear section (34). In another embodiment, the front and rear base sections (32, 34) are separate and distinct pieces that are separately produced. Preferably, a thermoforming process is used to form the unitary base (16) or the separate front and rear base sections (32, 34) that make up the base as described in further detail below.

A wide variety of resins including, for example, (meth) acrylic resins such polymethyl methacrylate (PMMA), polyurethane (PU), polyvinyl chloride (PVC), polycarbonate (PC), acrylonitrile/butadiene/styrene copolymer (ABS), polyolefins such as polyethylene (PE) and polypropylene (PP), polyesters such as polyethylene terephthalate (PET) and polyethylene naphthalate (PEN), and copolymers such as ethylene/acrylic acid copolymer, ethylene/ethyl acrylate copolymer, and ethylene/vinyl acetate copolymer, or mixtures thereof can be used to form the base. Preferably, a thermoplastic material is used to form the front and rear base sections (32, 34) as discussed in further detail below.

Particularly, the front base section (32) is a unitary piece including integrated endwall (36) and sidewalls (38, 40). Likewise, the rear base section (34) is a unitary piece including integrated endwall (44) and sidewalls (46, 48). The front and rear base sections (32, 34) are preferably joined together by at least one hinge, and preferably two separate hinges (50, 52). Any suitable material can be used to form the hinges (50, 52). For example, natural and synthetic leathers, natural and synthetic rubbers, foams, woven and non-wovens, and natural and synthetic textile fabrics, and films can be used. For example, synthetic textile fabrics made from nylons, polyesters, polyolefins, polyurethanes, rubbers, and combinations thereof can be used. Canvas fabrics also can be used. In one preferred embodiment, thermoplastic polyurethane fabric such as webbing or film pieces are used. These hinges (50, 52) are relatively small, distinct members used to join the front and rear base sections (32, 34) together as shown in FIG. 2, and do not extend across the entire width of the base. The hinges (50, 52) may be attached to the inside floor of the base (16) by rivets, screws, adhesives or any other suitable fastener. In other embodiments, as described further below, the front and rear base sections are not joined together by hinges (50, 52). In FIGS. 2, 2A, and 2B, the base has a generally elliptical shape. However, it is recognized that the base (16) can have other suitable shapes including, for example, oval, circular, square, rectangular, and regular or irregular polygonals. The base (16) is constructed so that its shape matches the cross-sectional shape of the body of the bag (12).

The base member (16) includes a plurality of support members (feet) (55) located on its bottom surface to provide additional stability. The feet (55) may be attached to the base (16) by any suitable fastener such as, for example, screws, rivets, stitching, or adhesives. The feet (55) also can be snapped-in to the base (16) so that they are locked in place. In an alternative example, the support feet (55) are integral components of the base (16). In yet another example, stitching is used to attach the support feet (55) to the base (16).

Leg Sub-Assemblies

Figure 3:
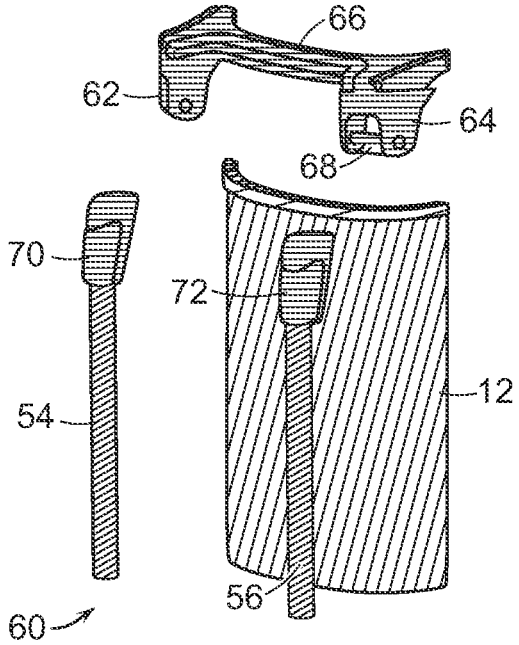
FIG. 3 is an exploded view of one embodiment of a leg sub-assembly for a golf bag of this invention.

As discussed above, the base of the present invention can be used to manufacture a variety of golf bags such as, for example, cart bags, stand bags, hybrid bags, carry bags, and the like. Golf stand bags are described above and these bags contain leg sub-assemblies for supporting the bag in a standing, tilted position. Any suitable leg sub-assembly can be used in accordance with this invention. In one example, as shown in in FIG. 3, the leg sub-assembly (60) includes two leg-supporting brackets (62, 64) joined by a central bracket-supporting member (66). The leg-support brackets (or seats) (62, 64) have a pin (68) that is inserted between the walls of each bracket (62, 64). The legs (54, 56) include upper connectors (70, 72) for coupling the legs to the leg-support members (62, 64). A pin (68) is inserted between the walls of the support members (62, 64) so that the legs (54, 56) can pivot outwardly. This example of a pivotable leg sub-assembly is not restrictive and should not be considered limiting. The legs can be pivotally engaged to the golf bag of the present invention in any other suitable way.

Figure 4:
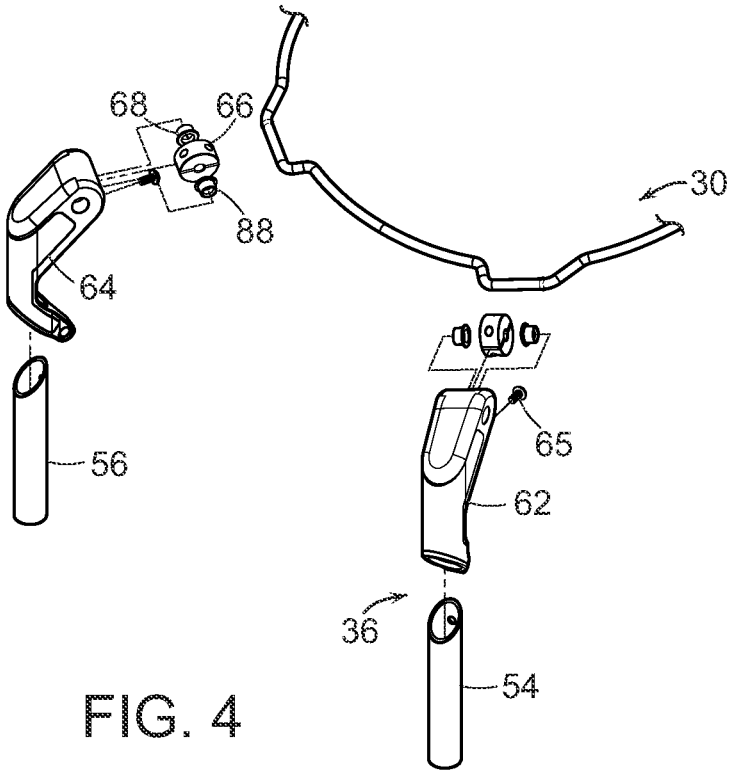
FIG. 4 is an exploded view of another embodiment of a leg sub-assembly for a golf bag of this invention.

In another example, referring to FIG. 4, the leg sub-assembly (60) is fastened to the top frame (30). The leg sub-assembly (60) includes two leg-supporting brackets (62, 64). The first leg-supporting bracket (62) is adapted for receiving a first leg (54), and the second leg-supporting bracket (64) is adapted for receiving a second leg (56). The leg-supporting brackets (62, 64) may contain set screws (65). The leg-supporting brackets (62, 64) (seats) may contain a collar (66) with bushings (68) that is inserted between the walls of the support members. The collar (66) allows the legs (54, 56) to pivot outwardly so they can support the bag (10) in a tilted, propped-up position.

Figure 5A:
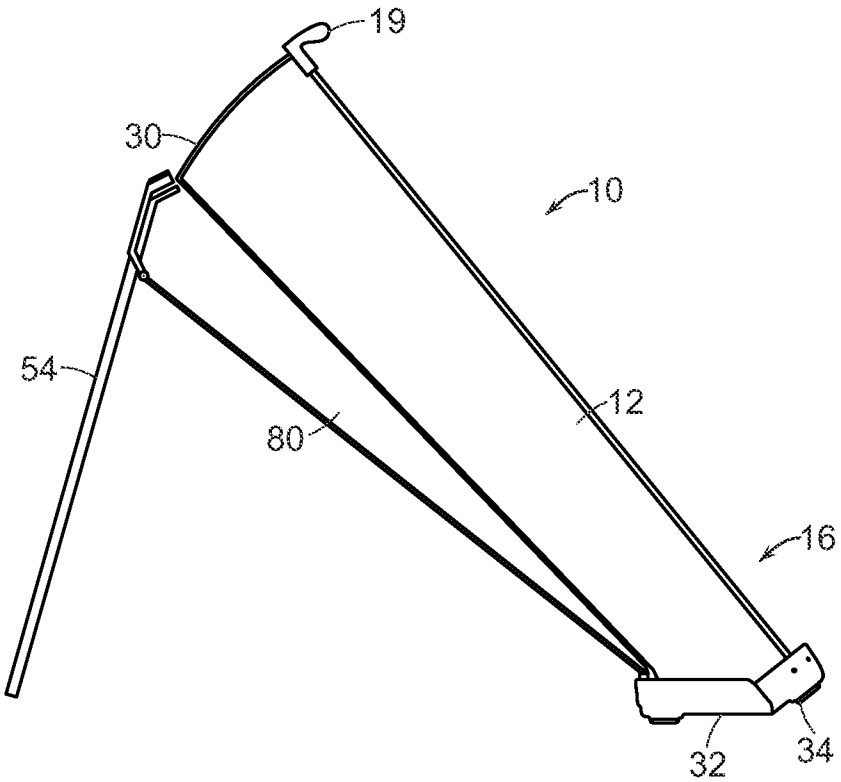
FIG. 5A is a side view of one embodiment of a golf bag of this invention showing the bag in an inclined position.
Figure 5:
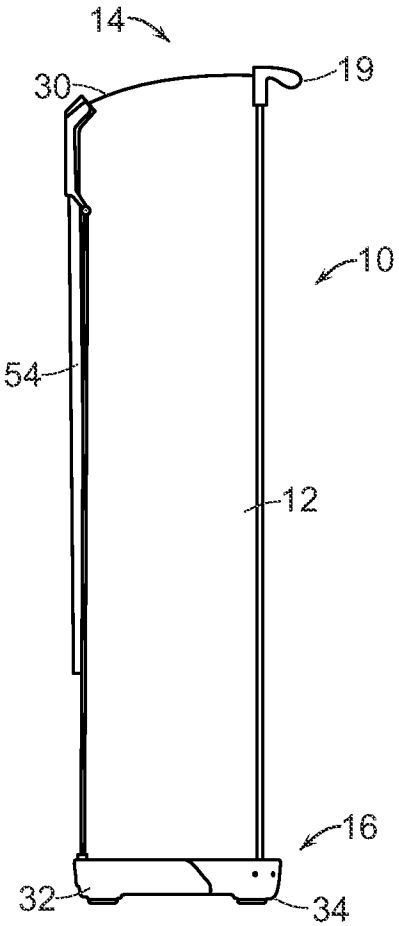
FIG. 5 is a side view of one embodiment of a golf bag of this invention showing the bag in an upright position.

In practice, the support legs (54, 56) of the golf bag are normally in their retracted position, and the bag (10) is supported completely by the base (16). Referring to FIG. 5, the golf bag (10) is shown standing on the ground in an upright position. The golf bag can be set so that it is standing in this vertical position, for example, when placed in storage, or when placing the bag on a level parking lot or clubhouse or locker room floor, and the like. During a round of golf, the bag can be placed in his upright position when the golf course terrain has a level surface such as, for example, on a fairway. In this position, the entire bottom surface of the base contacts the ground. The longitudinal axis of the bag is perpendicular to the ground and the weight of the clubs and other equipment in the bag is uniformly distributed.

In many cases when playing golf, the golfer or caddie will often need to place the bag (10) on non-level surfaces such as hills, valleys, and surfaces littered with rocks and sticks. This rough terrain can create an unstable platform for the golf bag. This instability is particularly a difficult problem when the golfer needs to reach for his/her clubs and the bag falls over. If a particular area on-course (or off-course) is not level or for preference, the golfer wants to place the bag in a tilted position, he/she can simply press their hand downwardly on the top cuff (30) of the bag. This downward pushing action causes the rear base section (34) to pivot relative to the front base section (36), and the actuator rods (80) to impart an upward force on the legs (54, 56).

Figure 5B:
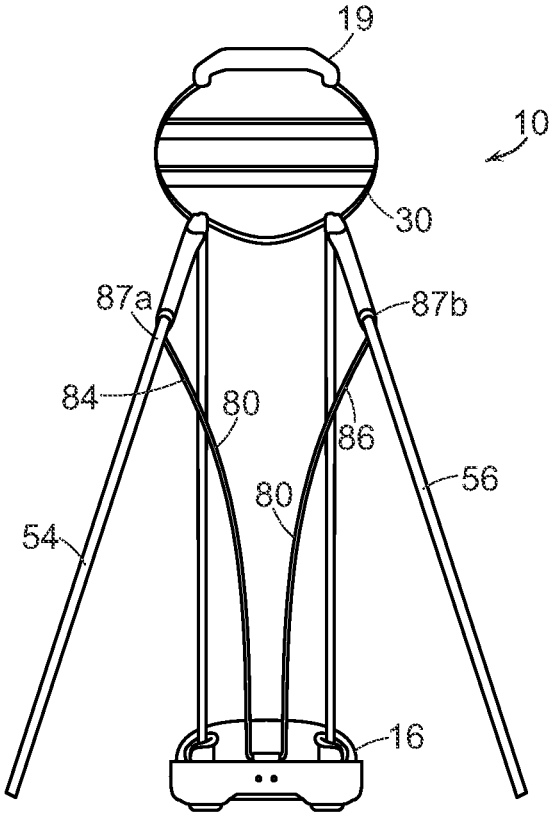
FIG. 5B is a front perspective view of one embodiment of a golf bag of this invention showing the bag in an inclined position.
Figure 6:
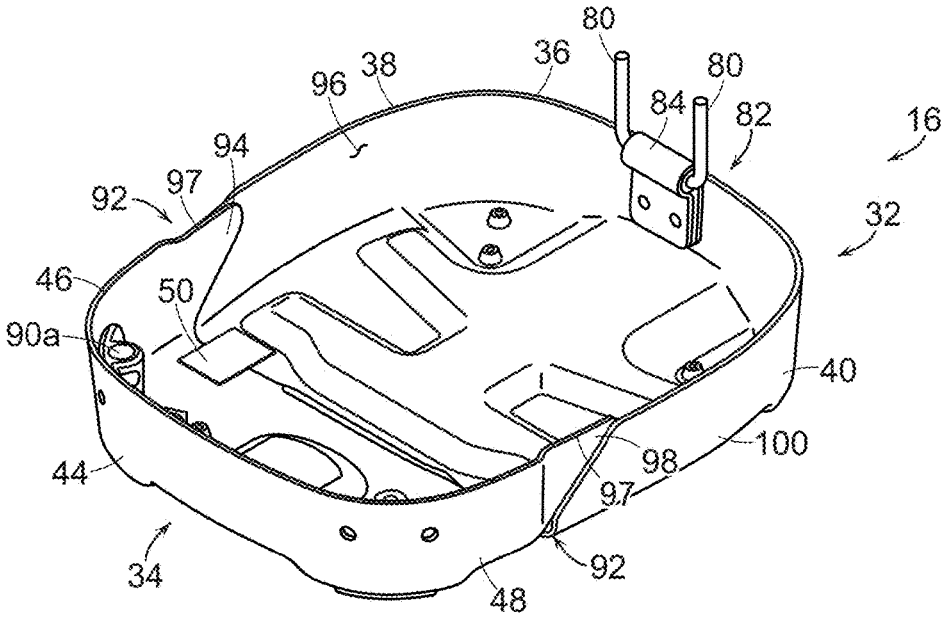
FIG. 6 is a perspective view of one embodiment of a base for a golf bag of this invention showing the base in a non-pivoted position.
Figure 6A:
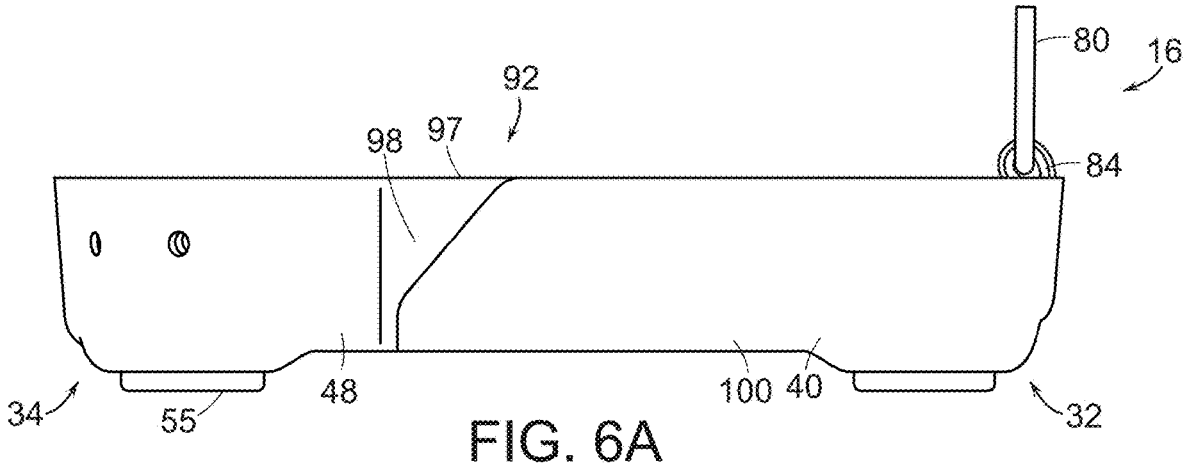
FIG. 6A is a side view of the base shown in FIG. 6.

In FIGS. 6 and 6A, the resilient actuator rods (80) are shown having a U-shaped proximal end (82) that is coupled to a rod connector member (84) in the base (16). The base also can include two mounted support post-holders (90*a*, 90*b*) for receiving support posts (not shown) that can be made from metal, carbon fiber composites, and the like. The support posts may be connected to a handle assembly (not shown) which is part of the top frame (30). The handle assembly normally forms an opening where a person can insert his/her hand through and grasp the handle. Turning back to FIGS. 5A and 5B, the resilient actuator rods (80) also include two distal ends (84, 86) that are attached to the respective support legs (54, 56) at rod attachment points (87*a*, 87*b*). When the rear base section (34) pivots relative to the front base section (32) (See FIGS. 7 and 8), this causes the actuator rods (80) to impart an upward force on the support legs (54, 56). This action forces the support legs (54, 56) to rotate and extend outwardly. The actuator rods (80) biases the support legs (54, 56) outwardly when the golf bag (10) is placed in a tilted position. The extended legs (54, 56) support the bag (10) as it stands in a tilted position. When a person lifts upwardly on the top cuff (30) of the bag, the actuator rods (80) biases the support legs (54, 56) inwardly and this causes the legs to retract. The support legs (54, 56) are pushed inwardly.

The support legs (54, 56) and actuator rods (80) are preferably made of a lightweight material having high mechanical strength such as, for example, aluminum, magnesium, aircraft aluminum, beryllium, carbon fiber, titanium, carbon fiber composites, metal alloys, and the like. These materials help reduce the overall weight of the bag (10).

Pivoting of Base

As discussed above, the golf bag (10) of this invention can be made to rest upon the ground in either an upright or inclined position. The rear section (34) of the base (16) is constructed to pivot and help change the position of the bag (10). When the bag (10) is in the upright position, the base (16) provides the sole point of contact with the ground. When the bag (10) is in a tilted position, the rear section (34) of the base (16) pivots upwardly and the distal tips of the support legs (54, 56) contact the ground. In this propped-up position, the weight of the clubs and other equipment in the bag (10) are distributed over the front portion of the base (16); the base (16) and legs (54, 56) work together to support the bag (10). This support mechanism by the base (16) and legs (54, 56) is particularly important when the bag is placed on a non-level surface and high stability is needed.

More particularly, referring to FIGS. 6-6A, when the golf bag (10) is in an upright position, the base (16) is level with the ground surface and in a non-pivoting position. In rear base section (34), the first sidewall (46) includes an angled tab (flange) portion (92) having an outside surface (not shown) and inside surface (94). The front base section (32) includes a first sidewall (38) having an inside surface (96) and outside surface (not shown). In FIG. 6, the outside surface of the angled tab (92) is in contact with the inside surface (96) of the front sidewall (38). Thus, the front base section (32) and rear base section (34) partially overlap each other. More particularly, the outside surface of the angled tab (92) and inside surface (96) of the front sidewall (38) are aligned and in contact with each other. The angled tab (92) has a generally bottlenose shape and the upper edge (97) of the angled tab (92) is level with the front and rear sidewalls (38, 46) when the base (16) is in this upright position. Further, the rear base section (34) is partially overlapped by the front base section (32) such that the outside angle ($\alpha$) is typically about 40 to about 60 degrees, preferably about 50 degrees; and the inside angle ($\beta$) formed by the angled tab (92) is typically about 30 to about 50 degrees, preferably about 40 degrees. The base (16) is symmetrical and the front base section (32) normally has a length of about 4 to about 8 inches (about 102 to about 203 mm) and a height of about 0.50 to about 3.50 inches (about 13 to about 89 mm). Preferably, the length of the front base section (32) is about 5 to about 7 inches (about 127 to about 178 mm) and the height is about 1 to about 2 inches (about 25 to about 51 mm). The rear base section (34), which is partially overlapped by the front base section (32) as described above, normally has a length of about 2 to about 5 inches (about 59 to about 127 mm) and a height of about 0.50 to about 3.50 inches (about 13 to about 89 mm). Preferably, the length of the rear base section is about 2.5 to about 4.5 inches (about 63 to about 114 mm) and the height is about 1 to 2 inches (about 25 to about 51 mm).

In a similar manner, as particularly shown in FIG. 6A, the opposing second sidewall (48) of the rear base section (34) includes an opposing angled tab (flange) (92) having an outside surface (98) and inside surface (not shown). The front base section (32) includes an opposing second sidewall (40) having an inside surface (not shown) and outside surface (100). As shown in FIGS. 6-6A, the outside surface (98) of the angled tab (92) is in contact with the inside surface of the front sidewall (40). Thus, the front base section (32) and rear base section (34) partially overlap each other on this opposing side of the base (16) as well. The outside surface (98) of the angled tab (92) and inside surface of front sidewall (40) are aligned and in contact with each other. There is no V-shaped or other shaped notch or other bridging member joining the front and rear base sections (32, 34) in this embodiment.

As further shown in FIG. 6, the base member (16) also may include a pattern of raised and recessed areas in the inside surface (inside floor) (105) of the base. These 3-dimensional areas can have a wide variety of geometric shapes and be arranged in any desired pattern. For example, these raised and recessed areas can be in arranged randomly or in a geometric order, for example, in a grid or lattice. The raised segments which can be in the form of ridges, ribs, protrusions, projections, and the like extend from the inside floor (105) of the base and can have any suitable shape and dimensions. The recessed areas are formed around the raised segments and resemble indentations. Thus, in this embodiment, instead of having a uniformly flat base inside floor (105), there are elevated areas and surrounding depressed areas. These raised and recessed areas can further enhance the strength and durability of the base. The raised and recessed areas can help increase the structural stiffness of the base.

Figure 7:
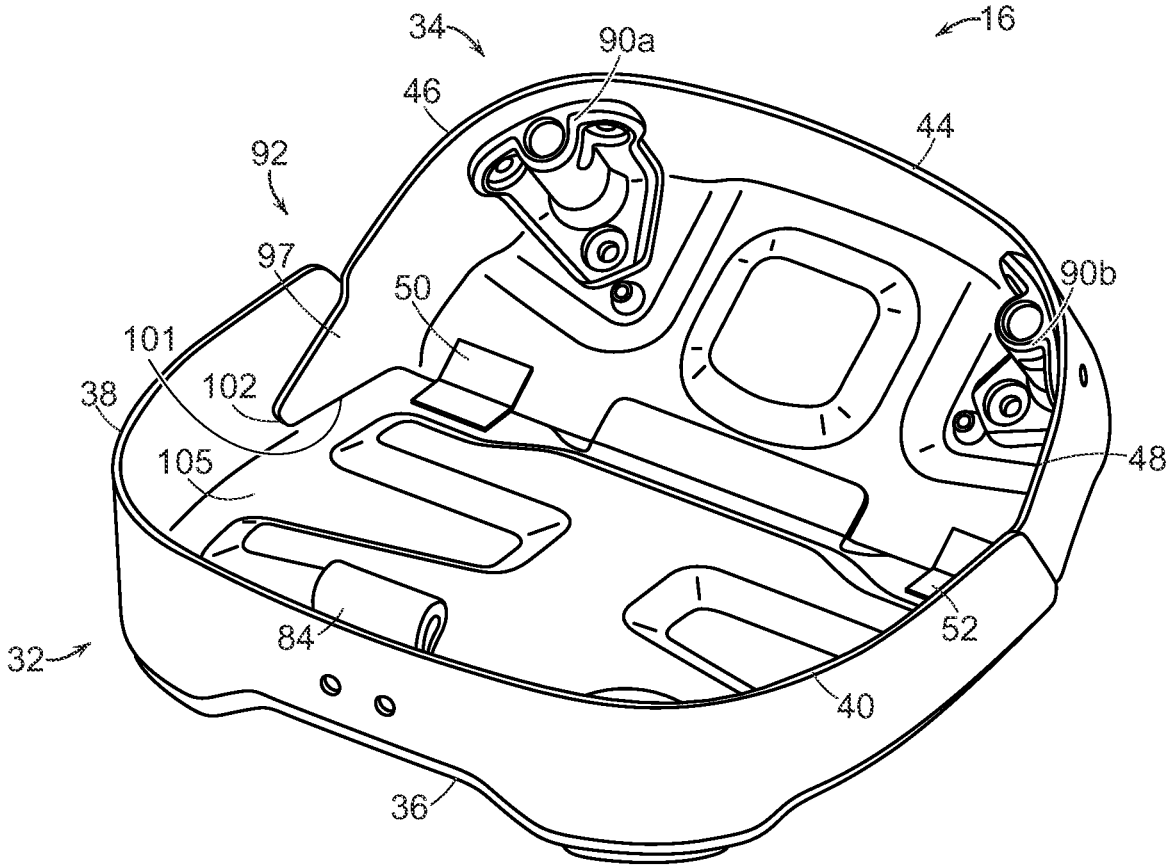
FIG. 7 is a perspective view of one embodiment of a base for a golf bag of this invention showing the base in a pivoted position.
Figure 8:
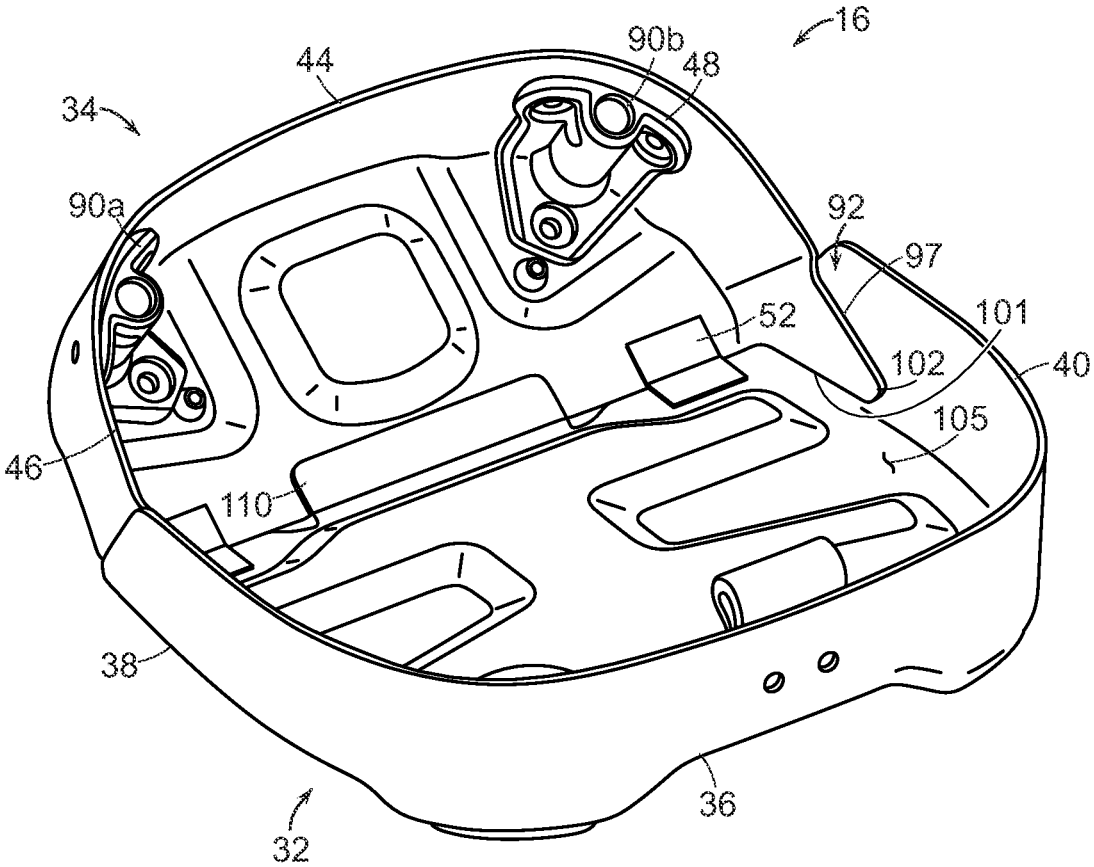
FIG. 8 is a second perspective view of the base shown in FIG. 7.

Referring now to FIGS. 7-8, when the golf bag (10) is moved to a forward tilted position as described above, the hinges (50, 52) flex and the rear section (34) of the base (16) pivots upwardly. This action causes the angled tab (flange) (92) of the first rear sidewall (46) to move downwardly so that a lower edge (101) of the angled tab (92) is positioned closely adjacent and parallel to the inside surface (floor) (105) of the base (16). In some instances, the angled tab (92) can make contact with the curved base floor (105). This action of the angled tab (92) also helps stop the pivoting of the rear base section (34) so that it does not pivot upwardly to an excessive amount. That is, the angled tab (92) acts as a stopper-like element, although the primary means for preventing over-pivoting of the rear base section (34) is the anti-rotation plate (110), which is described further below. As the angled tab (92) rotates downwardly so that it becomes disposed adjacent to the base floor (105), it helps prevent the rear base section (34) from rotating upwardly to an excessively high degree.

As further shown in FIGS. 7 and 8, the front base section (32) includes an integral anti-rotation plate (110), and this plate acts as the primary stopper for preventing the rear base section (34) from over-rotating. This flexible anti-rotation plate (flange) (110) extends from the floor (105) of the front base section (32) and overlaps a portion of the rear base section (34). The anti-rotation plate (110) normally has a length about 1 to about 4 inches (about 25 to about 102 mm) and preferably a length of about 2 to about 3 inches (about 51 to about 76 mm). The anti-rotation plate (110) catches and stops the rear base section (34) from over-rotating when the rear base section pivots upwardly. The anti-rotation plate (110) helps hold the base (16) in its pivoted position and prevents excessively high pivoting. Preferably, when the rear base section (34) is in a pivoted position, it makes an angle with the ground surface in the range of about 20 to about 60 degrees, more preferably about 30 to about 50 degrees.

As described above, in this pivoting position, the upper edge (97) of the angled tab (92) is no longer level with the front and rear sidewalls (38, 46). However, the front base section (32) and rear base section (34) are aligned with each other when the base is in this pivoted position. As shown in FIGS. 7-8, the angled tab (92) is forced downwardly so that its lower edge (101) comes to rest side-by-side with the base inside floor (105) and its nose (side edge) (102) is facing forward. In a similar manner, the opposing angled tab (92) on the opposing second rear sidewall (48) also moves downwardly so that its lower edge (101) is disposed adjacent to the base inside floor (105). The lower edge (101) of this angled tab (92) is forced downwardly so that it is comes to rest closely adjacent and parallel to the base inside floor (105). In this way, the front base section (32) and rear base section (34) are aligned with each other on this opposing side of the base (16) when the base is in a pivoted position.

Figure 9:
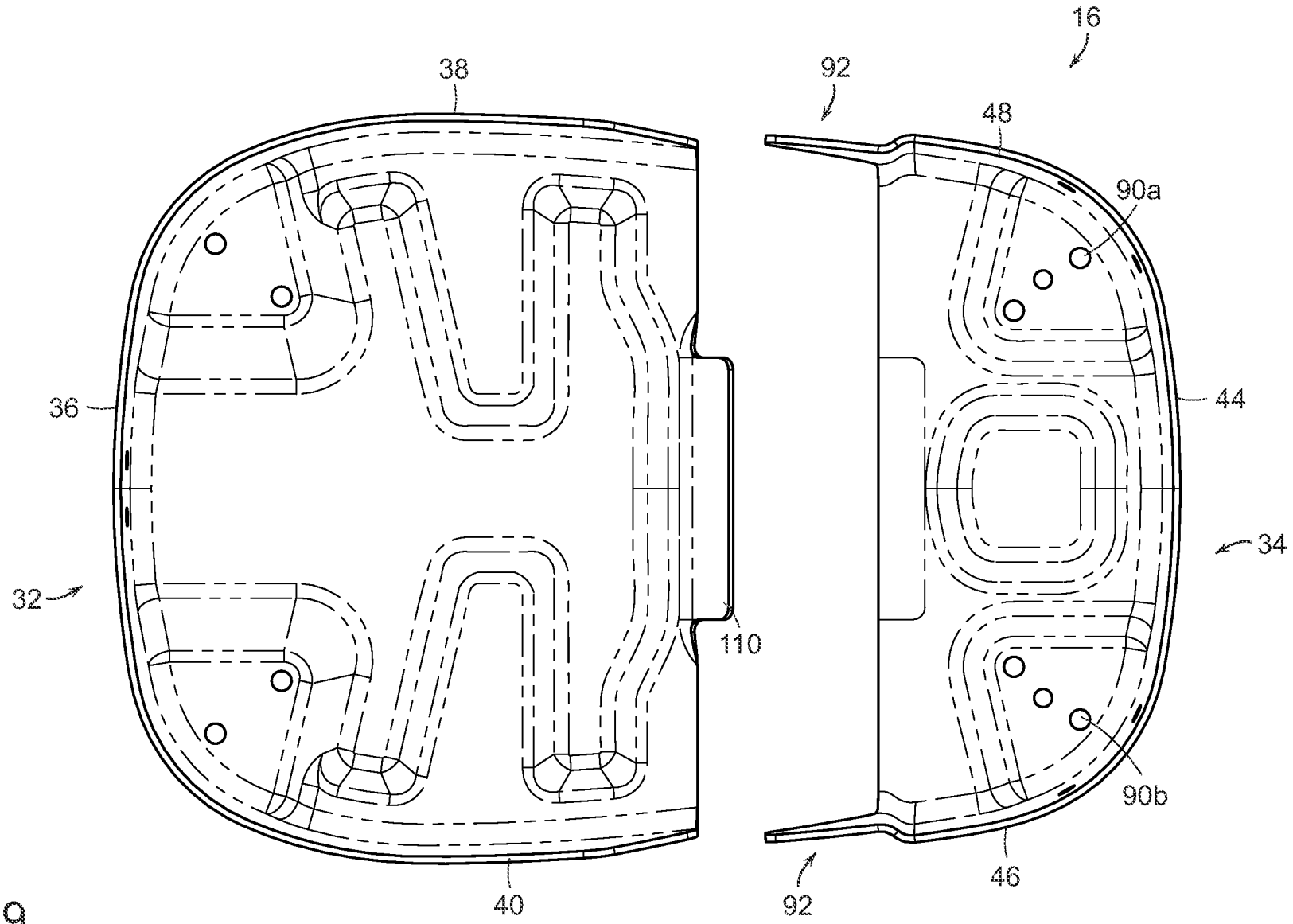
FIG. 9 is a top view of one embodiment of a base for a golf bag of this invention showing the front and rear base sections separated.
Figure 10A:
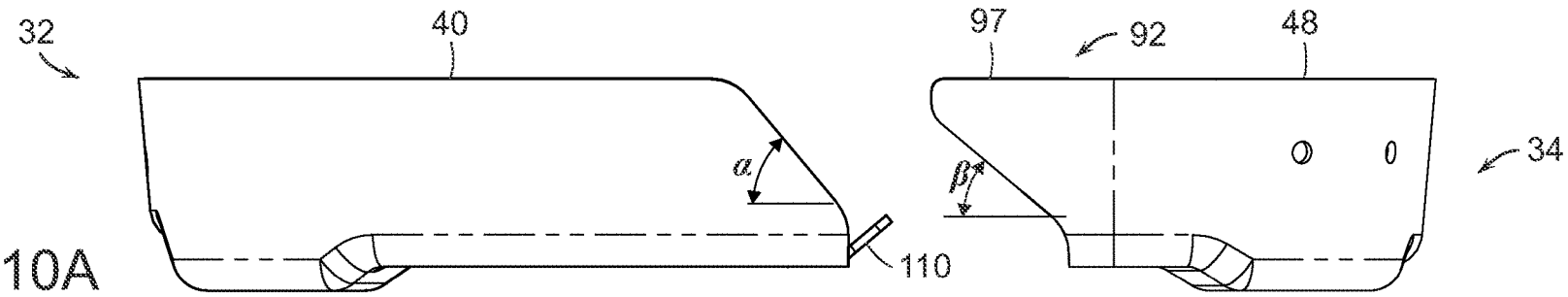
FIG. 10A is a side view of one embodiment of a base for a golf bag of this invention showing the front and rear base sections separated.
Figure 10B:
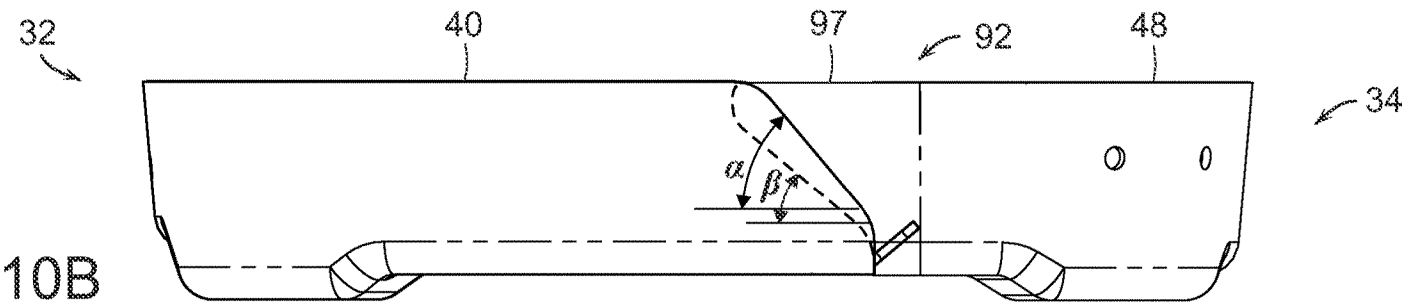
FIG. 10B is a side view of one embodiment of a base for a golf bag of this invention showing the base in a non-pivoted position.
Figure 10C:
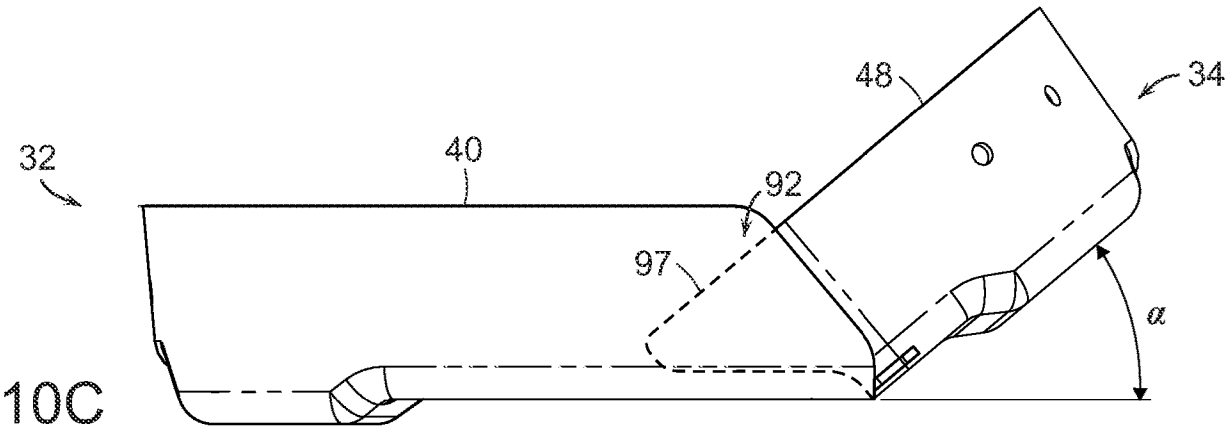
FIG. 10C is a side view of one embodiment of a base for a golf bag of this invention showing the base in a pivoted position.

Referring to FIG. 9, the base (16) is shown with the front and rear base sections (32, 34) separated. The bottlenose-shaped tabs (92), which align with the inside surfaces of the front sidewalls (38, 40) as the rear base section (34) rotates upwardly, as discussed above, is shown extending from the rear base section (34). The bottlenose-shaped tabs (92) extend from the left and right sides of the rear base section (34). The anti-rotation plate (110), which helps hold the base (16) in its pivoted position, as discussed above, is shown extending from the front base section (32). In FIGS. 10A-10C, the front and rear base sections (32, 34) are shown in different positions. In FIG. 10A, a side view of the separated front and rear base sections is shown. The outside angle ($\alpha$) is typically about 40 to about 60 degrees, preferably about 50 degrees; and the inside angle ($\beta$) formed by the angled tab (92) is typically about 30 to about 50 degrees, preferably about 40 degrees. In FIG. 10B, the rear base section (34) is shown partially overlapped by the front base section (32) such that the angled tab (92) is aligned with and makes contact with the inside surface of the front sidewall (40). In FIG. 10C, the rear base section (34) is shown rotated upwardly and being held in a pivoted position, it makes an angle with the ground surface in the range of about 20 to about 60 degrees, more preferably about 30 to about 50 degrees.

Other Bag Constructions

It is understood the golf bag base of the present invention can be used in any suitable golf bag construction including, but not limited to, cart bags, stand bags, hybrid bags, carry bags, and the like. The leg sub-assemblies shown in FIGS. 1-10C are for illustration purposes only and not meant to be restrictive. When a stand golf bag is desired, any suitable leg sub-assembly can be used with the base of this invention to construct the stand bag. In other embodiments, the base of this invention can be used on cart golf bags which do not contain a supporting leg sub-assembly. These cart bags are designed to be removably secured to a golf cart, for example, by a cart strap that extends through a handle, channel, or other fastening piece on the bag. The base of this invention also can be used to manufacture hybrid golf bags which include both a leg sub-assembly and a channel or other fastening piece for a cart strap so the bag can be fastened to a cart if needed. In yet another embodiment, the golf bag base can be used to fabricate carry bags which do not contain a leg assembly or a cart fastening piece; rather, these bags have carry straps so the golfer can carry the bag over their shoulders—the bag is laid on the ground when not being carried.

As discussed above, the bags may contain a shoulder strap system, for example, a two-strap harness or a single-strap harness. The shoulder harness is removably coupled to the bag by coupling members. The coupling members are attached to the tubular body. For example, in a two-strap system, four coupling receptor members can be used. Two coupling receptor members are fixed to the top frame of the bag and two other receptor elements are located in the lower portion of the bag. The shoulder straps contain cushioned portions which rest on the golfer's shoulders along with upper and lower connector webbing, which have snap-in pieces on their ends. The snap-in pieces are inserted into the receptor members on the bag so they snap and lock into place. In this way, the shoulder harness is removably coupled to the bag.

Figure 11:
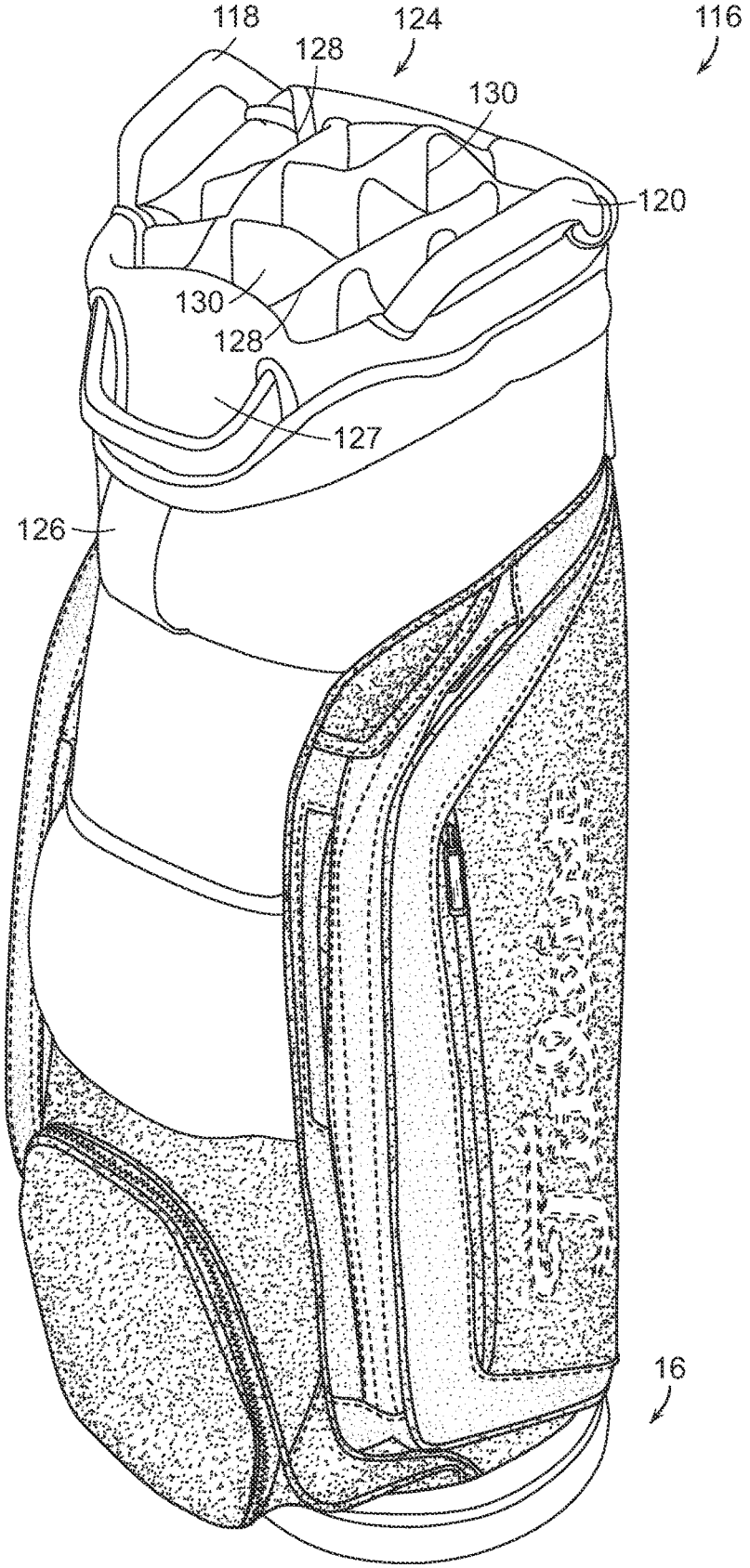
FIG. 11 is a perspective view of one embodiment of a golf bag of this invention that is particularly suitable for removably securing to a golf cart.

Turning to FIG. 11, one example of a golf bag (116) that is particularly suitable for use with golf carts is shown. The golf cart bag (116) is shown in FIG. 11 having handles (118, 120) extending upwardly from the top frame (cuff) (124). These handles (118, 120) allow the bag (116) to be easily picked up and placed on a golf cart platform, which is typically located at the rear of the cart. Preferably, the golf cart bag (116) comprises an elongated tubular body having a top opening and closed bottom base, wherein the top opening includes at least one handle extending therefrom. For example, the top frame (124) can have two handles; one handle (118) extending from the top frame along the left side and another handle (120) extending from the top frame along the right side. The golf bag (116) can be secured to the golf cart by a cart strap that extends through an open channel piece (126) on the bag. In FIG. 11, the handles (118, 120) are shown extending from a fourteen (14)-way top cuff (124), which includes an integrated putter well (127). In the top frame (124), the club dividers (128) form fourteen (14) separate compartments or slots (130) for holding the golf clubs (not shown). In this embodiment, each compartment (130) is configured to receive one golf club. However, it should be understood the top cuff (124) can contain any suitable number of club dividers (128); for example, there can be two, three, four, or five, and the like slots (130) and each slot can hold multiple clubs. Each compartment (130) can be configured to receive at least one club. Also, the top frame (124) can have a single handle or any suitable number of multiple handles; for example, there can be three extending handles. When needed, the cart strap (not shown), which runs through the open channel piece (126), can be loosened and the golf bag removed from the golf cart. In FIG. 11, the handles (118, 120) allow the bag (116) to be easily picked up and removed from the golf cart.

In another embodiment, the front base section (32) and rear base section (34) of the base (16) are not joined together by a set of attached separate and distinct hinge members (50, 52) as shown in FIG. 2. Rather, the front and rear base sections (32, 34) are joined by a flexible intermediate section disposed between a front base section and rear base section. The flexible intermediate section forms an interface between the front and rear base sections (32, 34) such that the rear base section pivots relative to the front base section along the flexible section. The flexible section acts as pivoting point. Preferably, in this embodiment of the golf bag, the front and rear base sections (32, 34) are formed from the self-reinforced polymer composite sheet material as described in further detail below. A thermoforming process can be used to form the base from the self-reinforced polymer composite sheet material as also described below. In one example, the front and rear base sections (32, 34) can be formed of the self-reinforced polymer composite sheet material and the flexible section can be formed of an elastomeric material such as rubber. In one embodiment, the base (16) is formed as a unitary piece such that the flexible section is not a separate element. That is, the base (16) can be molded as a single piece comprising the front and rear base sections (32, 34) that are joined together by the intermediate flexible section. A thermoforming process can be used to make such a base (16), where the flexible section acts as a living hinge and interface between the front and rear sections (32,34).

Materials for Forming Base

The golf bag base (16) of this invention can be made of a variety of materials including thermoplastics, thermosets, and fiber-reinforced composites. In one example of a fiber-reinforced composite sheet material, there is a binding matrix (resin) and reinforcing fiber made of different polymer materials. For example, the binding polymer can be a thermoset material such as epoxy or rubber. Thermoplastic resins such as polyesters, polyolefins, polyamides, and polyurethanes also can be used. Preferably, carbon fiber is used as the reinforcing fibers. Other fibers such as aramids (for example, Kevlar™), aluminum, or glass fibers can be used in addition to or in place of the carbon fibers. The fiber-reinforced composites can be manufactured using standard techniques, where the reinforcing fibers are impregnated with a resinous material, such as epoxy. This resin is used as a matrix to bind the reinforcement fibers. These impregnated materials may be laid-up to form a laminate sheet structure which is cured at high temperatures to solidify the composite material.

In a particularly preferred embodiment, a "self-reinforced polymer composite sheet material" is used to form the golf bag base (16) of this invention. The front and rear base sections (32, 34) of the base (16) can comprise a self-reinforced polymer composite sheet material. That is, the front base section (32) including integrated endwall (36) and sidewalls (38, 40) and floor (105) can be molded from a self-reinforced polymer composite sheet material; and the rear base section (34) including integrated endwall (44) and sidewalls (38, 40) can be molded from a self-reinforced polymer composite sheet material. Preferably, a thermoforming process is used to mold the self-reinforced polymer composite sheet material into the base sections (32, 34) as described in further detail below. Self-reinforced polymer composite sheet materials are generally known in the composite industry and refer to fiber-reinforced composites comprising reinforcing fibers and a polymer matrix, where highly oriented reinforcing fibers are made from the same polymer in which the matrix is made. "Highly oriented" fibers are generally known in the industry and refer to the crystalline structure of the polymer molecules. When the fibers are drawn, they are stretched to align the crystalline structure of the polymer molecules and orientation refers to the degree of parallelism of the polymer chain molecules. If the polymer chains are oriented substantially parallel to each other, as opposed to being entangled, they are considered highly oriented and have better mechanical properties such as stiffness and tensile strength.

For example, a polypropylene matrix can be reinforced with polypropylene fibers. Polypropylene homopolymers can be used. That is, the self-reinforced polymer composite sheet material can be made of pure polypropylene or another pure suitable polymer. There is no need to load the composition with glass or other mineral fillers. As described below, a fiber-drawing process is used and this high-orienting of the polymer during fiber production makes the fibers stiffer. After weaving the fibers into a fabric, the outer surfaces of the fibers are selectively melted and this melted material is re-crystallized to form a polymer matrix surrounding the fibers. Different thermoplastic polymers can be used including, for example, polyethylene, polypropylene, polyethylene terephthalate, polymethyl methacrylate, liquid crystal polymers, polylactic acid, and polyamides. Self-reinforced polymer composite sheet materials are commercially available and sold, for example, under the trademarks of Pure® (DIT BV and Milliken USA (formerly Lankhorst Pure Composites, The Netherlands); Armordon® (Don & Low, Ltd., Scotland, UK); and Curv® (Propex Furnishing Solutions GmbH&Co. KG (Gronau, Germany).

Self-reinforced polymer composite sheet materials can be made using various technologies including hot compaction and co-extrusion methods. In general, hot-compaction refers to a method by which highly oriented polymer fibers, preferably tapes, are heated and consolidated. As discussed above, highly oriented fibers have optimum stiffness and strength are first produced. The drawing or stretching process used to form the fibers helps impart these good mechanical strength properties. Then, the fibers are woven into a strong fabric with balanced properties in all directions. The fabric is fed into a hot press under precise temperature and pressure control. The heating is very selective so that only the outer skins of the fibers in the fabric are melted. When pressure is applied, the molten polymer surface skin of the fibers flow through the lattice of the fibers to form a continuous matrix. The melted outer skin is re-crystallized to form the polymer matrix for the composite structure. The fibers are bonded together resulting in a composite material with strong continuity between the phases. The composite is then cooled while still under pressure to solidify the polymer matrix, and a highly stiff, smooth composite sheet is produced. After cooling, the consolidated composite sheet material is cut into the appropriate width and length so that it can be later molded into the desired part as described below. The resulting composite sheet has a high strength to weight ratio.

Figure 12A:
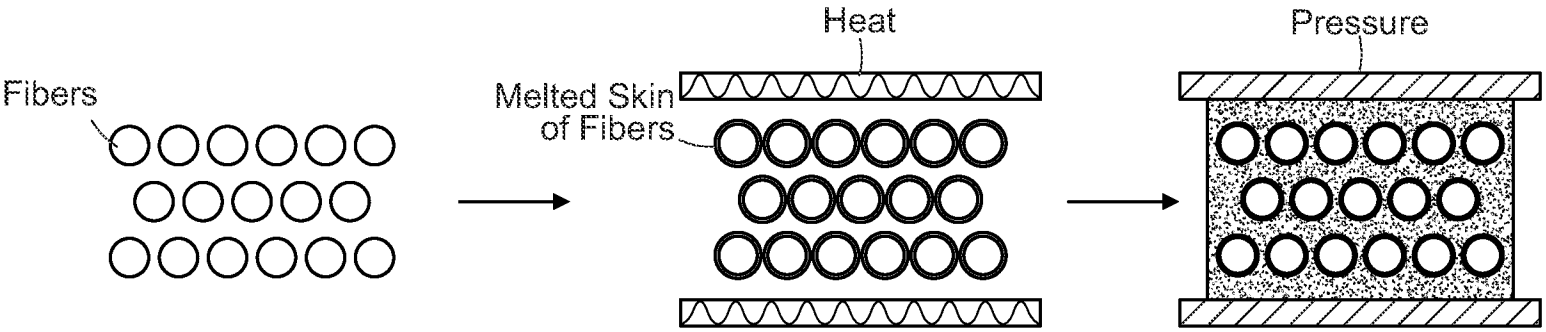
FIG. 12A is a schematic diagram showing a fabric comprising fiber strands that is hot-compacted to form a composite self-reinforced polymer sheet in accordance with the present invention.
Figure 12B:
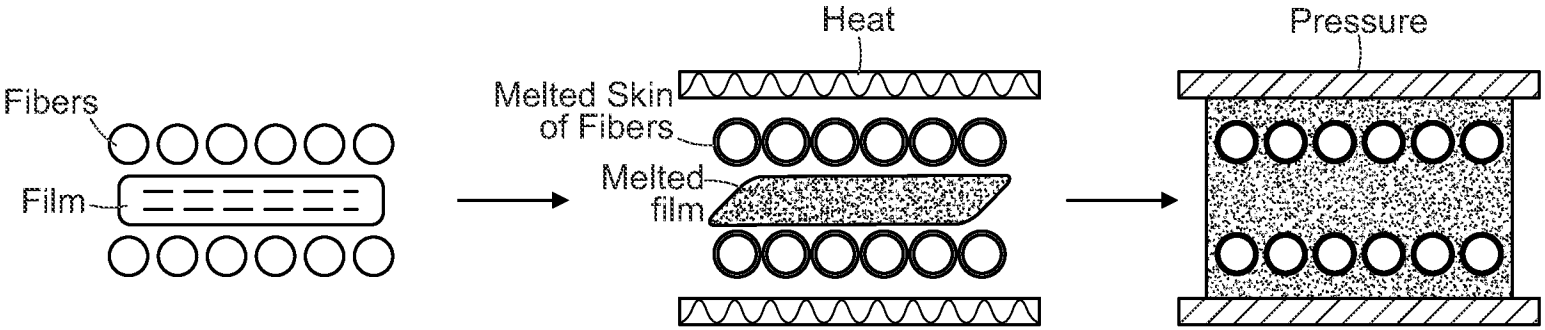
FIG. 12B is a schematic diagram showing a fabric comprising fiber strands and a film disposed between the fiber strands, wherein the fabric is hot-compacted to form a composite self-reinforced polymer sheet in accordance with the present invention.

This hot compaction process is illustrated in the schematic diagram, FIG. 12A, where a fabric comprising strands of fiber, is consolidated to form the composite self-reinforced polymer sheet material; and in the schematic diagram, FIG. 12B, where an interlayer of film is disposed between the fiber layers. These processes are further described in Ward et al., U.S. Pat. No. 9,873,239 and PCT Published International Application WO 2010/032048 A1, the disclosures of which are hereby incorporated by reference. The rigid sheet materials produced by these hot compaction processes can then be thermoformed into a golf bag base in accordance with this invention as described further below.

In a co-extrusion process, a high melting point grade of the polymer is used to extrude highly oriented polymer tapes (fibers). During this process, a low-melting point grade of the same polymer family is extruded on the surface of the tape. These tapes can then be woven to form a fabric. During post-processing into shaped parts and articles, the outer layers of the tapes melt before the inner cores of the oriented polymer. Under pressure, the low melt grade polymer flows throughout the fabric. On cooling, this low melt grade polymer re-solidifies to form the composite matrix and a composite sheet is produced.

These self-reinforced composite sheet materials are lightweight and have high strength. Other advantageous properties include, for example, a high stiffness, high tensile strength, and outstanding impact resistance. Because the reinforcement fibers and matrix are made of the same polymer, they are chemically compatible and there is low interfacial failure.

In particular, these self-reinforced composite sheet materials have low density, preferably less than about 1.0 g/cm$^3$ and more preferably less than 0.95 g/cm$^3$ (as measured according to ISO1183). The combination of highly oriented tapes and matrix made of the same polymer helps provide a lightweight sheet material with good physical properties such as strength, toughness, and modulus.

The self-reinforced composite sheet materials also have high impact strength. The Charpy Impact strength is greater than 90 kJ/m$^2$, more preferably greater than 100 kJ/m$^2$, and even more preferably greater than 110 kJ/m$^2$ (as measured according to EN ISO 179/2). The Tensile Strain to Failure (as measured according to DIN EN ISO 527) is preferably at least 10%. The Compression strength (flat wise) (as measured according to EN ISO 604) is preferably greater than 200 MPa and more preferably greater than 250 MPa.

The self-reinforced composite sheet materials are ductile materials that stay ductile at low temperatures. That is, these composites maintain their toughness and do not become brittle at cold temperatures. Furthermore, these composites can be recycled easily since the reinforcing material is made of the same polymer as the polymer matrix. The composites are made entirely of thermoplastic so the component part can be broken down, re-melted and then re-granulated so that it can be used to make new components.

These self-reinforced polymer composite sheet materials and methods of manufacturing are described in the patent literature including, for example, Ward et al., U.S. Pat. Nos. 9,873,239; 8,871,333; 8,268,439; 8,052,913; and 8,021,592 (Propex) and Loos et al., U.S. Pat. No. 7,318,961 (Lankhurst); and Nair et al., U.S. Pat. No. 7,960,024 and Callaway, U.S. Pat. 7,300,691 (Milliken), the disclosures of which are hereby incorporated by reference.

In one preferred embodiment, the self-reinforced polymer composite sheet material comprises a fabric ply having at least two fabric layers, wherein a portion of each of the at least two layers has been melted. More preferably, the fabric ply has at least three fabric layers, wherein a portion of each of the at least three layers has been melted. As discussed above, the self-reinforced polymer composite sheet material is preferably made from highly oriented fibers having an outer skin that has been precisely melted. In forming the sheet, the molten polymer skin flows to form a continuous matrix around the fibers. The sheet is cooled, the molten fiber skin is recrystallized, and a highly stiff, smooth self-reinforced polymer composite sheet is produced.

In one embodiment, the self-reinforced composite sheet material can comprise a ply of at least three successive layers wherein a portion of each of the at least three layers has been melted. Preferably, the first (top) and third (bottom) layers of the ply comprise the same type of polymer and the second (intermediate layer comprises a polymer with the same or similar chemical composition and grade of polymer as the first and third layers with a lower degree of molecular orientation and a lower melting temperature than that of the first and third layers. The second layer is disposed between the first and third layers. The second layer of the ply can have a thickness that is less than the thickness of either the first layer or second layer of the ply. Suitable polymers than can be used to form the ply include, but are not limited to polyethylene, polypropylene, polyoxymethylene, polyester, and copolymers and blends thereof. In one example, the first and third layers are non-woven webs. In another example, the first and third layers are fabrics that are woven from flat tapes.

More particularly, the ply can have successive layers, for example: (i) a first layer made up of strands of an oriented polymeric material; (ii) a second layer of a polymeric material; and (iii) a third layer made up of strands of an oriented polymeric material, wherein the second layer has a lower peak melting temperature than that of the first and third layers. The ply is subjected to conditions of time, temperature and pressure sufficient to melt a proportion of the first layer, to melt the second layer entirely, and to melt a proportion of the third layer; and to compact the ply; and then the compacted ply is cooled. Different cooling methods can be used such as, for example, permitting the compacted ply to cool naturally; forced draught cooling; plunge cooling; any other type of accelerated cooling; and retarded cooling.

The strands may be in any suitable form including, but not limited to, fibers and filaments. For example, the strands may be in the form of bands, ribbons or tapes; and then may be laid in a non-woven web. Alternatively, the strands may be formed into yarns comprising multiple fibers or filaments, or they may be used in the form of a monofilament yarn. The strands may be formed into a fabric by weaving or knitting. Woven fabrics are preferably made up of tapes, fibers, yarns, or filament yarns, or they may comprise a mixture of fiber or filament yarns and tapes. Preferably, the first and third layers are fabrics which are woven from flat tapes, as this geometry is believed to give the best translation of the oriented phase properties into the properties of the final compacted sheet.

In some embodiments, the strands of the oriented polymeric material of the first and third layers preferably comprises a polymer selected from the group consisting of polyethylene, polypropylene, polyoxymethylene, and polyester, and blends thereof. These polymer materials include, for example, homopolymers, copolymers, and terpolymers. Polymer blends and filled polymers can be used in some embodiments.

In some embodiments, the second layer also may comprise a polymer selected from the group consisting of polyethylene, polypropylene, polyoxymethylene, and polyester, and blends thereof. These polymer materials include, for example, homopolymers, copolymers, and terpolymers. Polymer blends and filled polymers can be used in some embodiments.

Preferably the first, second, and third layers are of the same type of polymeric material (for example, polypropylene or polyethylene). In one embodiment, the second layer is of the same or similar chemical composition and grade as the first and third layers, except for the fact that it is of lower orientation (and thus melts at a lower temperature than the first and third layers.)

The second layer can be formed in situ on the first or third layer, for example by delivering the polymeric material of the second layer to the respective first or third layer in particulate form, for example, by spraying. Alternatively, the second layer is pre-formed, and is laid onto the first or third layer. The second layer can be pre-formed from strands of the polymeric material. The strands can be laid into a non-woven web. They can be formed into yarns comprising multiple filaments or fibers, or used in the form of a monofilament yarn. The strands, for example, filaments, fibers, yarns, tapes, and the like can be formed into a fabric by weaving or knitting. In another embodiment, the second layer comprises a film. The film may typically have a uniaxial or biaxial orientation resulting from its formation, but such that the degree of orientation will typically be much less than that of the strands which make up the first and third layers. "Biaxially oriented" films are generally known in the industry and are produced by stretching the film in both the machine and transverse directions. The second layer may be made up of a plurality of films, or a single film.

The polypropylene self-reinforced polymer composite sheet material, Curv®, available from (Propex Furnishing Solutions GmbH&Co. KG (Gronau, Germany) is a particularly preferred material for making the golf bag bases of this invention. The Curv® self-reinforced polymer composite sheet material is based on highly oriented tapes made of polypropylene homopolymer. During a precisely controlled heating process, the polypropylene tapes are heated so that only a thin outer layer of the tapes is melted. The outer melted material bonds the tapes together while the tapes maintain their orientation through most of their thickness. The melted portions are cooled and recrystallized, to form the resulting Curv® self-reinforced polymer composite sheet material.

The Curv® self-reinforced polymer composite sheet material can be molded to form the golf bag base of this invention using a thermoforming process. The thermoforming process include matched tool compression molding steps. The Curv® self-reinforced polymer composite sheet material has a relatively high stiffness even at molding temperatures so moderate pressure is needed to shape the sheet material. In one process, the Curv® self-reinforced polymer composite sheet material is heated to a moderate temperature, where the shrinkage of the sheet is kept low. The Curv® self-reinforced polymer composite sheet material is molded by moderate pressure compression molding. Because of the Curv® self-reinforced polymer composite sheet material's high stiffness, vacuum thermoforming is not used.

When numerical lower limits and numerical upper limits are set forth herein, it is contemplated that any combination of these values may be used. Other than in the operating examples, or unless otherwise expressly specified, all of the numerical ranges, amounts, values and percentages such as those for amounts of materials and others in the specification may be read as if prefaced by the word "about" even though the term "about" may not expressly appear with the value, amount or range. Accordingly, unless indicated to the contrary, the numerical parameters set forth in the specification and attached claims are approximations that may vary depending upon the desired properties sought to be obtained by the present invention.

It also should be understood the terms, "first", "second", "third", "top", "bottom", "intermediate", "forward", "rear", "upper", "lower", "upward", "downward", "right", "left", "middle" "proximal", "distal", and the like are arbitrary terms used to refer to one position of an element based on one perspective and should not be construed as limiting the scope of the invention.

All patents, publications, test procedures, and other references cited herein, including priority documents, are fully incorporated by reference to the extent such disclosure is not inconsistent with this invention and for all jurisdictions in which such incorporation is permitted. It is understood that the golf bags, golf bag components, golf bag assemblies and sub-assemblies, and materials described and illustrated herein represent only some embodiments of the invention. It is appreciated by those skilled in the art that various changes and additions can be made to such products and materials without departing from the spirit and scope of this invention. It is intended that all such embodiments be covered by the appended claims.

We claim:

1. A golf bag, comprising:

an elongated tubular body for storing golf clubs, the tubular body having a top opening and a closed bottom base, the base having (i) a front base section comprising a front bottom surface and a front sidewall being formed of a plurality of composite sheets and (ii) a rear base section comprising a rear bottom surface and a rear sidewall being formed of a plurality of composite sheets, the rear base section being pivotally connected to the front base section to form a hinged connection for moving the golf bag between an upright position and a tilted position, wherein the rear base section includes an angled tab that extends across the hinged connection when the bag is in the upright position, wherein the angled tab extends along an inner surface portion of the front sidewall, and wherein the inner surface portion of the front sidewall surrounds an outer surface portion of the angled tab, wherein the angled tab is configured to move downwardly towards the front bottom surface and wherein the rear bottom surface is configured to pivot upwardly relative to the front bottom surface as the golf bag moves to the tilted position, wherein the angled tab is configured to contact the front bottom surface of the front base section to stop the rear base section from pivoting beyond a predetermined angle ranging from about 20 degrees to about 60 degrees relative to the front bottom surface, wherein the angled tab comprises an upper edge, a lower edge opposite the upper edge, and a side edge extending between the upper edge and the lower edge, wherein the lower edge is configured to extend across and over the front bottom surface of the front base section when the bag is in the upright position, and wherein an entirety of the lower edge is parallel to the front bottom surface of the front base section when the bag is in the tilted position;

a first leg and a second leg pivotally attached to the tubular body;

a first actuator rod having a proximal end that is coupled to an upper region of the first leg and a distal end that is coupled to the front base section; and a second actuator rod having a proximal end that is coupled to an upper region of the second leg and a distal end that is coupled to the front base section so that as the rear base section pivots relative to the front base section, the first and second actuator rods move the first leg and the second leg outwardly and into an extended position to support the bag.

2. The golf bag of claim 1, wherein the composite sheets forming the front and rear base sections comprise a self-reinforced polymer composite sheet material comprising a polypropylene homopolymer, copolymer, or terpolymer.

3. The golf bag of claim 1, wherein the angled tab is configured to extend past both sides of the hinged connection when the bag is in the upright position.

4. The golf bag of claim 1, wherein the hinged connection is positioned closer towards a rear end of the rear base section than a front end of the front base section.

5. The golf bag of claim 1, wherein the front base section includes a first end wall extending along a front end of the front base section, wherein the rear base section includes a second end wall extending along a rear end of the rear base section, wherein the first end wall and the second end wall each have a constant or uniform height.

6. The golf bag of claim 1, wherein the front base section includes an anti-rotation plate extending from the front bottom surface of the front base section and overlapping the rear bottom surface of the rear base section, wherein the anti-rotation plate is configured to catch and stop the rear base section from rotating beyond the predetermined angle.

7. The golf bag of claim 6, wherein the lower edge of the angled tab is configured to extend across and over the front bottom surface of the front base section at a first angle when the bag is in the upright position, and wherein the anti-rotation plate is configured to overlap the rear bottom surface of the rear base section at a second angle corresponding to the first angle when the bag is in the upright position.

8. The golf bag of claim 6, wherein the angled tab is configured to extend across the hinged connection in a first direction from the rear base section to the front base section, and wherein the anti-rotation plate is configured to extend across the hinged connection in a second direction from the front base section to the rear base section.

9. The golf bag of claim 6, wherein the anti-rotation plate is decoupled from the rear bottom surface of the rear base section so that the plate functions independently of the hinged connection to prevent the rear base section from over-rotating.

10. The golf bag of claim 6, wherein the anti-rotation plate is configured as a primary stopper for preventing the rear base section from over-rotating, and wherein the angled tab is configured to help stop the pivoting of the rear base section so that the rear base section does not pivot upwardly by an excessive amount.

11. A golf bag, comprising:

an elongated tubular body for storing golf clubs, the tubular body comprising a top opening and a closed bottom base, wherein the base comprises a self-reinforced polymer composite sheet material formed from at least three successive layers, the base having (i) a front base section comprising a front bottom surface and a front sidewall and (ii) a rear base section comprising a rear bottom surface and a rear sidewall, the rear base section being pivotally connected to the front base section to form a hinged connection for moving the golf bag between an upright position and a tilted position, wherein the rear base section includes an angled tab that extends across the hinged connection when the bag is in the upright position, wherein the angled tab extends along an inner surface portion of the front sidewall, and wherein the inner surface portion of the front sidewall surrounds an outer surface portion of the angled tab, wherein the angled tab is configured to move towards the front bottom surface and wherein the rear bottom surface is configured to pivot upwardly relative to the front bottom surface as the golf bag moves to the tilted position, wherein the angled tab is configured to contact the front bottom surface of the front base section to stop the rear base section from pivoting beyond a predetermined angle relative to the front bottom surface, wherein the angled tab comprises an upper edge, a lower edge opposite the upper edge, and a side edge extending between the upper edge and the lower edge, wherein the lower edge is configured to extend across and over the front bottom surface of the front base section when the bag is in the upright position, and wherein an entirety of the lower edge is parallel to the front bottom surface of the front base section when the bag is in the tilted position.

12. The golf bag of claim 11, wherein a top layer and a bottom layer of the composite sheet material comprise a first polymer and an intermediate layer comprises a second polymer with a lower degree of molecular orientation and a lower melting temperature than the first polymer.

13. The golf bag of claim 12, wherein the intermediate layer has a first thickness that is less than a second thickness of either the top layer or the bottom layer.

14. The golf bag of claim 12, wherein the first and second polymers are selected from the group consisting of polyethylene, polypropylene, polyoxymethylene, polyester, and copolymers and blends thereof.

15. The golf bag of claim 12, wherein the top layer and the bottom layer are non-woven webs.

16. The golf bag of claim 12, wherein the top layer and the bottom layer are formed from fabrics that are woven from flat tapes.

17. The golf bag of claim 12, wherein the intermediate layer comprises a non-woven web or a film.

18. A golf bag, comprising:

an elongated tubular body for storing golf clubs, the tubular body having a top opening and a closed bottom base, the base having (i) a front base section comprising a front bottom surface and a front sidewall, (ii) a rear base section comprising a rear bottom surface and a rear sidewall, and (iii) a flexible intermediate section disposed between the front base section and the rear base section, the flexible intermediate section forming an interface between the front and rear base sections such that the rear base section pivots relative to the front base section along the flexible section to move the golf bag between an upright position and a tilted position, the front base section being formed of a plurality of composite sheets and the rear base section being formed of a plurality of composite sheets, wherein the rear base section includes an angled tab that extends across the flexible intermediate section when the golf bag is in the upright position, wherein the angled tab extends along an inner surface portion of the front sidewall, and wherein the inner surface portion of the front sidewall surrounds an outer surface portion of the angled tab, wherein the angled tab moves towards the front bottom surface and wherein the rear bottom surface pivots upwardly relative to the front bottom surface as the golf bag moves to the tilted position, wherein the angled tab contacts the front bottom surface of the front base section to stop the rear base section from pivoting beyond a predetermined angle relative to the front bottom surface, wherein the angled tab comprises an upper edge, a lower edge opposite the upper edge, and a side edge extending between the upper edge and the lower edge, wherein the lower edge is configured to extend across and over the front bottom surface of the front base section when the bag is in the upright position, and wherein an entirety of the lower edge is parallel to the front bottom surface of the front base section when the bag is in the tilted position.

19. The golf bag of claim 18, wherein the composite sheets forming the front and rear base sections comprise a self-reinforced polymer composite sheet material, wherein the self-reinforced polymer composite sheet material comprises a polypropylene homopolymer, copolymer, or terpolymer.

20. The golf bag of claim 19, wherein the flexible section is formed of an elastomeric material.

* * * * *